US008882201B2

(12) United States Patent
Gorza

(10) Patent No.: US 8,882,201 B2
(45) Date of Patent: Nov. 11, 2014

(54) SEAT ELEMENT

(75) Inventor: Roberto Gorza, Belluno (IT)

(73) Assignee: Arper S.p.A., Monastier di Treviso (IT)

( * ) Notice: Subject to any disclaimer, the term of this patent is extended or adjusted under 35 U.S.C. 154(b) by 0 days.

(21) Appl. No.: 13/266,157

(22) PCT Filed: Mar. 24, 2011

(86) PCT No.: PCT/IB2011/051260

§ 371 (c)(1),
(2), (4) Date: Oct. 25, 2011

(87) PCT Pub. No.: WO2011/124999

PCT Pub. Date: Oct. 13, 2011

(65) Prior Publication Data

US 2012/0056464 A1 Mar. 8, 2012

(30) Foreign Application Priority Data

Apr. 9, 2010 (IT) ..... PD2010A0116

(51) Int. Cl.

| | |
|---|---|
| ***A47C 7/00*** | (2006.01) |
| ***A47C 3/12*** | (2006.01) |
| ***A47C 3/04*** | (2006.01) |
| ***A47C 4/02*** | (2006.01) |
| ***A47C 4/03*** | (2006.01) |

(52) U.S. Cl.

CPC ... *A47C 3/12* (2013.01); *A47C 3/04* (2013.01); *A47C 4/02* (2013.01); *A47C 4/03* (2013.01)

USPC ..... 297/440.22; 297/440.15; 297/440.1

(58) Field of Classification Search

USPC ..... 297/440.2, 440.22, 440.15, 440.1

See application file for complete search history.

(56) References Cited

U.S. PATENT DOCUMENTS

| | | | | |
|---|---|---|---|---|
| 2,997,339 | A * | 8/1961 | Wilson | 297/239 |
| 3,393,941 | A * | 7/1968 | Grosfillex | 297/440.22 |
| 3,669,497 | A * | 6/1972 | Massonnet | 297/448.1 |
| 3,734,561 | A * | 5/1973 | Barecki et al. | 297/239 |
| 3,758,159 | A * | 9/1973 | Morris | 297/452.14 |
| 4,836,609 | A * | 6/1989 | Hill | 297/452.55 |
| 4,892,355 | A * | 1/1990 | Fend | 297/440.22 |
| 5,601,333 | A * | 2/1997 | Bostrom et al. | 297/218.5 |

(Continued)

FOREIGN PATENT DOCUMENTS

FR 2282249 A1 3/1976

OTHER PUBLICATIONS

International Search Report and Written Opinion for PCT/IB2011/051260, mailed Jun. 30, 2011; ISA/EP.

*Primary Examiner* — David R Dunn
*Assistant Examiner* — Richard Lowry
(74) *Attorney, Agent, or Firm* — Harness, Dickey & Pierce, PLC

(57) ABSTRACT

Seat element, comprising a frame, a seat associable to said frame, the frame and the seat being made separately from each other and being attachable and detachable from each other by the interposition of first coupling means. Advantageously, the first coupling means comprise at least one elastic hook and a protuberance, able to form a snap coupling with each other, the elastic hook being positioned so as to intercept the protuberance in a vertical assembly direction.

The elastic hook has a coupling end and a hook end, flexible in relation to the coupling end, so as to snap hook onto an undercut of the protuberance in the vertical assembly direction.

15 Claims, 4 Drawing Sheets

(56) References Cited

U.S. PATENT DOCUMENTS

| | | | | |
|---|---|---|---|---|
| 6,149,240 | A * | 11/2000 | Pietrzak | 297/440.22 |
| 6,273,510 | B1 * | 8/2001 | Ehemann | 297/440.22 |
| 7,137,670 | B2 * | 11/2006 | Gupta et al. | 297/452.65 |
| 7,331,628 | B2 * | 2/2008 | Lin | 297/16.2 |
| 7,651,162 | B2 * | 1/2010 | Segato | 297/195.1 |
| 7,690,730 | B2 * | 4/2010 | Yasuda et al. | 297/440.22 |
| 7,963,613 | B2 * | 6/2011 | Felmeri | 297/440.22 |
| 2007/0290512 | A1 | 12/2007 | Fan et al. | |

* cited by examiner

SEAT ELEMENT

CROSS-REFERENCE TO RELATED APPLICATIONS

This application is a 371 U.S. National Stage of International Application No. PCT/IB2011/051260, filed Mar. 24, 2011, and claims priority to Italian patent application No. PD2010A000116, filed Apr. 9, 2010, the disclosures of which are herein incorporated by reference in their entirety.

FIELD OF THE INVENTION

The present invention relates to a seat element, such as for example a chair or a stool or the like, comprising a frame and a seat made separately from each other and subsequently assembled.

BACKGROUND OF THE INVENTION

It is known of in the art to make seats and frames separately, is preferably in different materials, to then assemble them to each other. The interconnection between the frame and the seat is usually made by riveting, bolting or by means of screws passing through the seat so as to engage in relative holes made in the frame.

Such structures have the drawback of requiring, for their assembly, the use of riveting machines or of staff specialised in assembly operations and interconnecting parts by means of the aforementioned coupling devices.

For this reason, the seat elements of the prior art are usually assembled during the production process so that the final product is for example a chair or stool already assembled and ready to use. The pre-assembled structure has the disadvantage however of proving cumbersome and inconvenient both to store and to transport.

Seat element structures are also known of in the art in two separate parts which can be attached to each other by shaped coupling means between respective counter-shaped portions of the frame and of the seat.

Such shaped coupling means do not however ensure stable and safe coupling over time. In other words with wear and on account of the inevitable production tolerances there is often annoying and unacceptable play between the seat and the frame.

In addition, the coupling means of the prior art tend to break during the assembly phase and often ruin the seat through abrasion during the assembly and/or subsequent dismantling phase.

The deterioration of the seat, even if on the under part of the seat and is therefore quite remote, is not acceptable in the case in which the seat is upholstered for example in a precious material. In addition, in the case of an upholstered seat, the abrasion and damage of the covering may lead the mechanism to jam.

SUMMARY OF THE INVENTION

The purpose of the present teachings is to make a seat element which resolves the drawbacks mentioned with reference to the prior art. Such drawbacks and limitations are resolved by the disclosed embodiments of seat elements.

BRIEF DESCRIPTION OF THE DRAWINGS

Further characteristics and advantages of the present teachings will be clearly comprehensible from the description given below of its embodiments, made by way of a non-limiting example, wherein.

DETAILED DESCRIPTION OF THE INVENTION

Figure 1:
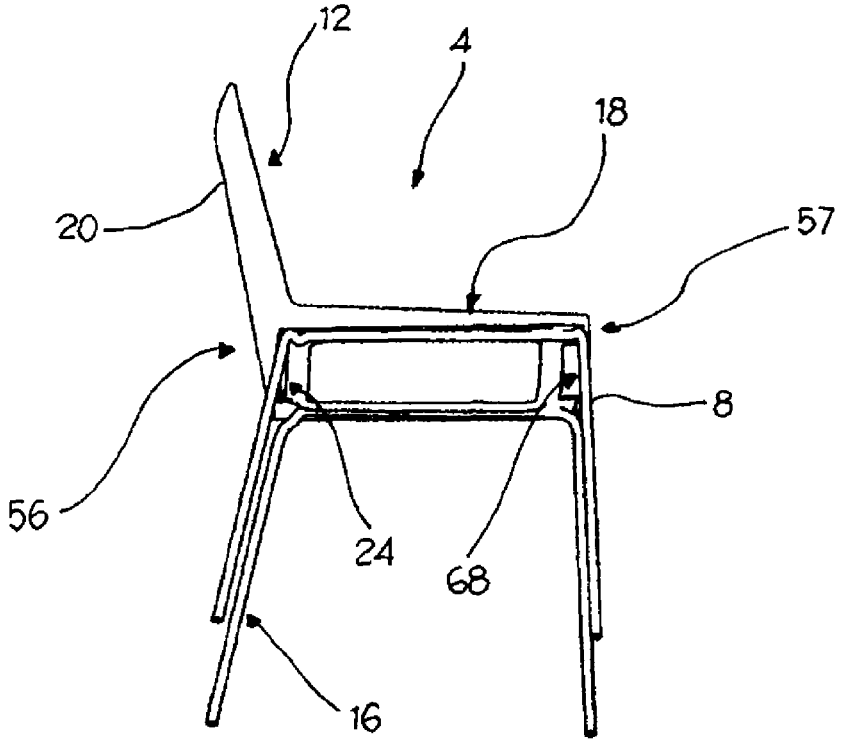
FIG. 1 shows a perspective view in an assembled configuration of a seat element according to one embodiment of the present teachings.
Figure 2:
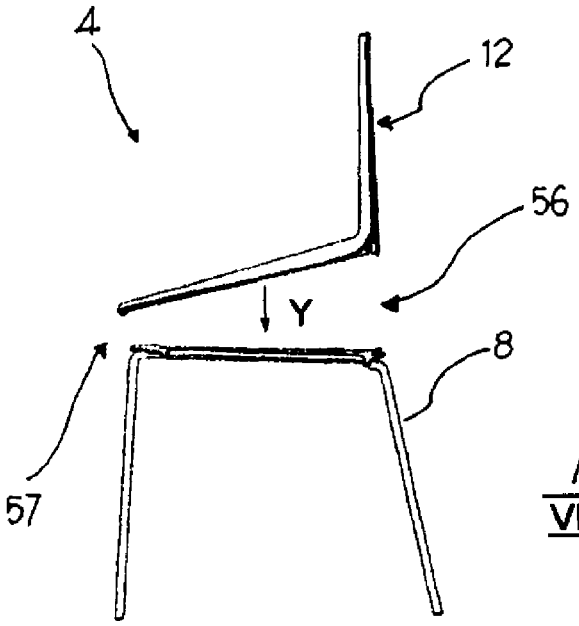
FIGS. 2-6 show side views, partially in cross-section, of phases of the assembly sequence of the seat element in FIG. 1.
Figure 3:
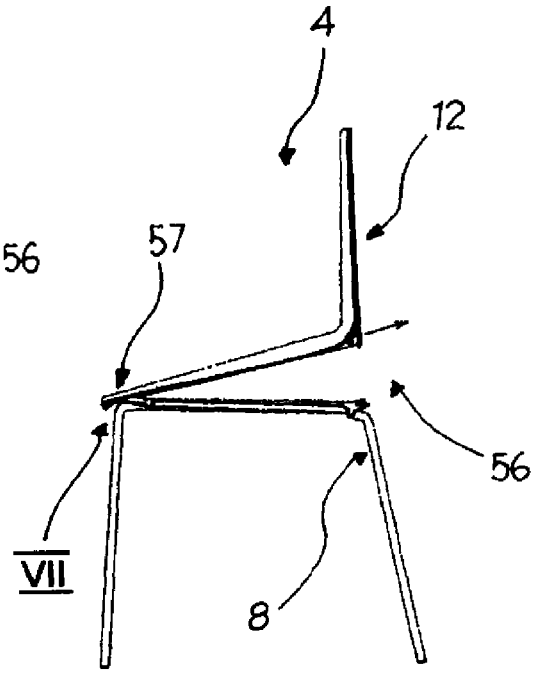
Figure 4:
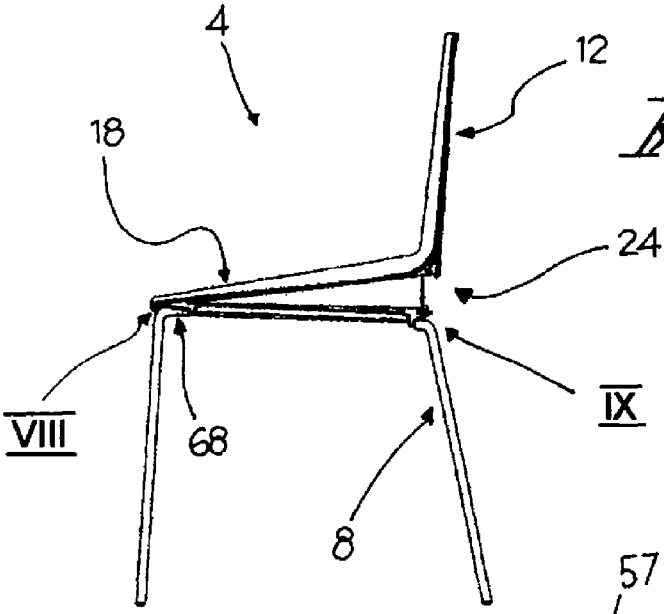

The elements or parts of elements common to the embodiments described below will be indicated using the same reference numerals.

With reference to the aforesaid drawings, reference numeral 4 globally denotes a seat element; the seat element may be of any type, such as for example a chair, a stool or even an armchair or tub chair.

The representation of a chair shown in the appended drawings should therefore be considered by way of a non-limiting example of the possible realizations of the present teachings.

The seat element 4 comprises a frame 8 able to sustain an associable seat 12 and provided with at least one means of support 16, such as a leg or a foot.

The frame 8 is preferably made of metal and is of the tubular type. The means of support 16 may be of any type, such as for example a plurality is of legs, a central column fitted with arms with or without castors, a tubular structure bent into a "C" and so forth.

The seat 12 may be of various shapes, materials and dimensions; the seat 12 defines a seat plane 18 for a user and may be fitted or not with a backrest 20, substantially perpendicular to the seat plane 18.

The frame 8 and the seat 12 are made separately from each other and are attachable and detachable from each other by the interposition of first coupling means 24.

The first coupling means 24 comprise at least one elastic hook 28 and a protuberance 32, able to form a snap coupling with each other. The elastic hook 28 is positioned so as to intercept the protuberance 32 in a vertical assembly direction Y-Y, substantially perpendicular to the seat plane 18.

The elastic hook 28 has a coupling end 36 and a hook end 40, flexible in relation to the coupling end 36, so as to snap hook onto an undercut 44 of the protuberance 32 in the vertical assembly direction Y-Y.

The coupling end 36 may be blocked in position for example by the interposition of screws, clamps or slotted shaped couplings.

According to one possible embodiment, the protuberance 32 is fixed to the frame 8 and the elastic hook 28 is fixed to the seat 12 on a lower portion 48 of the seat 12 directly facing the frame 8 in an assembly configuration.

According to one embodiment, the elastic hook 28 presents a slot 52 is at the hooking end 40 directly facing the protuberance 32 to facilitate snap coupling with the protuberance 32.

According to one possible embodiment, the hooking end 40 may be a "V" shape, wherein one of the sides of the "V" forms the slot 52 to facilitate snap coupling with the protuberance 32.

The elastic hooks 28 are preferably attached to the seat 12 and the protuberances 32 are attached to the frame 8.

The protuberances 32 are joined to the frame 8 and overhang the frame 8 so as to be facing the associable seat 12.

According to one embodiment, the protuberance 32 is at least partially counter-shaped to the corresponding lower portion 48 of the seat 12, on the side opposite the associable elastic hook 28, so as to form a support for the seat 12 in an assembled configuration of the seat element 4.

According to one embodiment, the seat element 4 comprises at least two elastic hooks 28 and two respective protuberances 32, preferably aligned along the same side or portion of the seat element 4.

According to one embodiment, the first coupling means 24 are aligned along a rear portion 56 of the seat element 4, at an associable backrest 20 of the seat element 4.

It is also possible to position the first coupling means on a front portion 57 of the seat element 4, opposite the rear portion 56, or on side portions 58,59 substantially perpendicular to said front and rear portions 57,56.

According to one embodiment, the first coupling means 24 are positioned along at least two separate portions 56, 57, 58, 59 of the seat element 4.

According to one embodiment, the elastic hooks 28 are at least partially housed inside hollows 60 made in the seat 12 at the lower portion 48 so as not to be visible on the outside, said hollows 60 being open towards the associable frame 8.

The seat element 4 comprises second coupling means 68, positioned between the frame 8 and the seat 12 and separate from the first coupling means 24.

The second coupling means 68 comprise a bracket 72 and a bent portion 76 able to fasten itself to the bracket 72 by means of a shaped coupling.

The second coupling means 68 are positioned on a separate, and preferably opposite, portion 56, 57, 58, 59 of the seat to that on which the first coupling means 24 are positioned.

The second coupling means 68 form a shaped coupling of a type rotating in relation to a transversal rotation axis X-X, perpendicular to the vertical assembly direction Y-Y, so that, following the relative coupling of the second coupling means 68, it is possible to realise the snap coupling of the first coupling means 24, by rotating the frame 8 and the seat 12 in relation to each other around the transversal rotation axis X-X.

The first and the second coupling means 24, 68 are positioned on opposite front and rear portions 56, 57 which, in an assembled configuration, form a bilateral axial constraint in a longitudinal direction Z-Z, perpendicular to said sides and to the transversal rotation axis X-X.

According to one embodiment, the seat element 4 comprises blocking means 88 able to prevent translation between the seat 12 and the frame 8 in a direction parallel to the transversal rotation axis X-X.

For example, said blocking means 88 comprise stops or rabbets to block any translation between the frame 8 and the seat 12 along the transversal rotation axis X-X. According to one embodiment, said blocking means 88 comprise pegs 90 which fit into corresponding holes 91 so as to achieve the relative blocking of the seat 12 to the frame 8 in the direction of the transversal rotation axis X-X. For example, the pegs 90 are made in the seat 12, on the lower portion 48, and the holes 91 are made on the frame 8, on the support plates 93 for the associable seat 12. The blocking means 88 also perform a centring function of the frame 8 in relation to the seat 12.

The bent portion 76 is joined to the seat 12 and is bent towards an associable frame 8 so as to identify a seat 92 able to house and cover the bracket 72.

The bracket 72 is joined to the frame 8 and overhangs the frame 8 so as to be facing the associable seat 12.

The assembly method of a seat element according to the invention will now be described.

In particular, the first step is to couple the second coupling means, inclining the seat 12 so as to insert the bracket 72 in the seat 92 defined by the bent portion 76 of the seat 12 (FIGS. 3, 4, 7, 8, 12).

The seat 12 is then rotated so as to approach the frame 8: the rotation takes place thanks to the rotary coupling of the bent portion 76 and the bracket 72 which ensures, during rotation, the coupling of the frame 8 to the seat 12.

Figure 6:
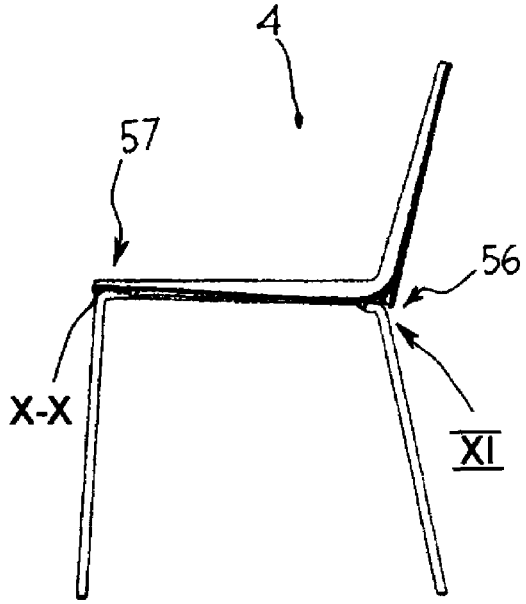
Figure 5:
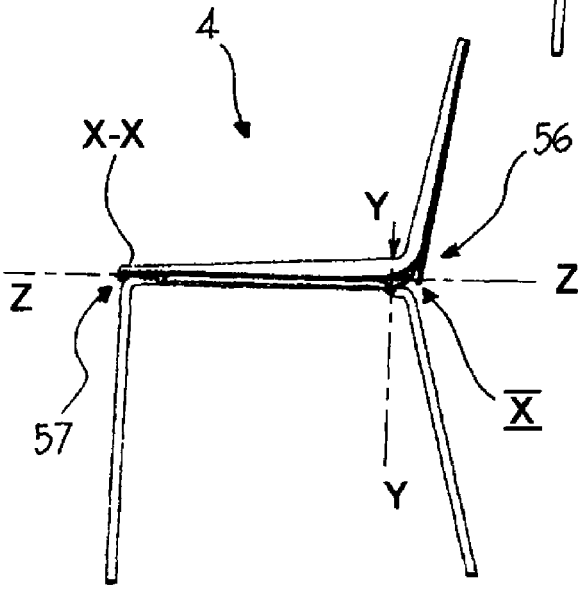
Figure 7:
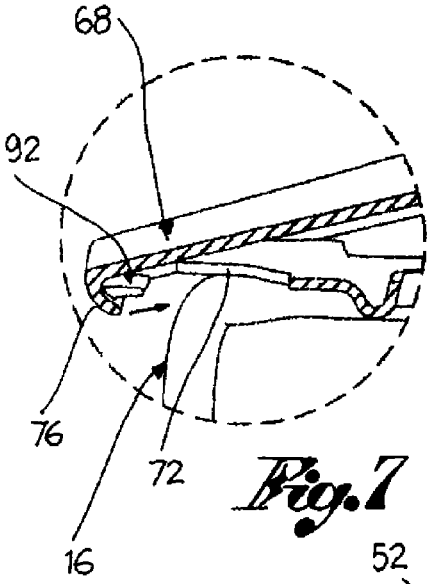
FIG. 7 shows a cross-section view of the enlarged detail VII in FIG. 3.
Figure 8:
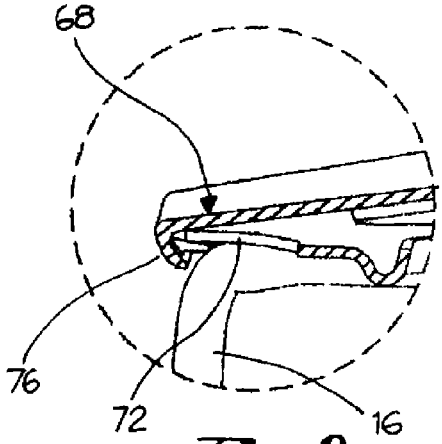
FIGS. 8 and 9 respectively show cross-section views of the enlarged details VIII and IX in FIG. 4.
Figure 9:
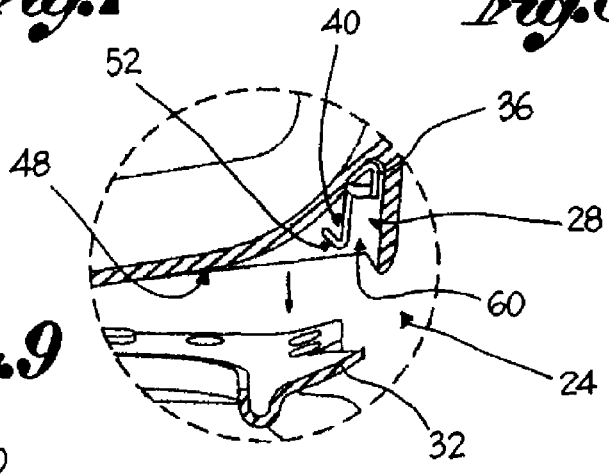
Figure 10:
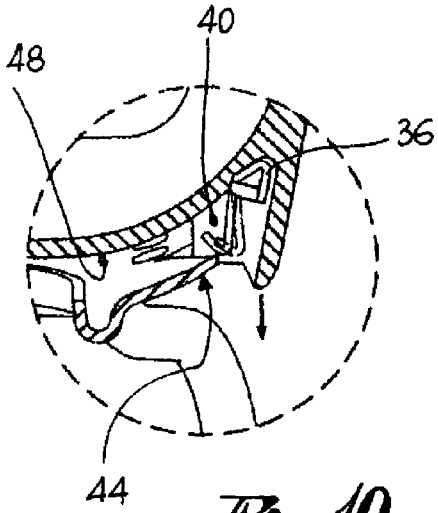
FIG. 10 shows a cross-section view of the enlarged detail X in FIG. 5.
Figure 11:
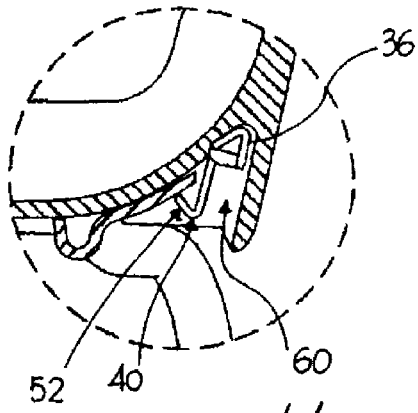
FIG. 11 shows a cross-section view of the enlarged detail XI in FIG. 6.
Figure 12:
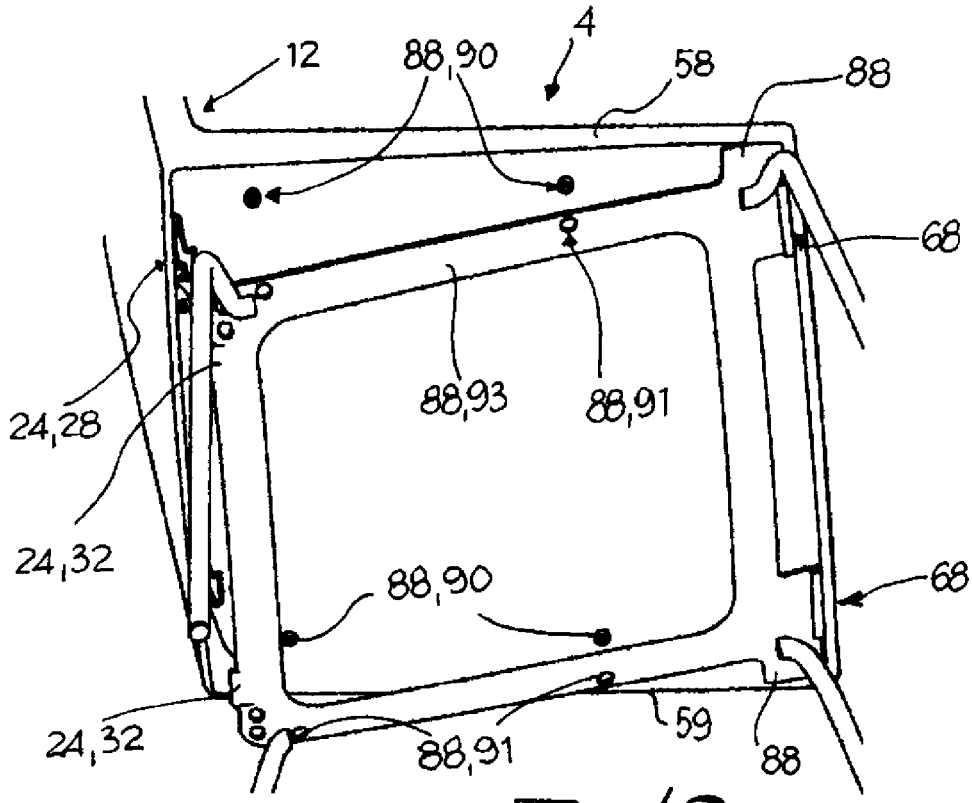
FIGS. 12 and 13 show respective perspective views of the seat element in FIG. 1, in further angulations, in various phases of assembly.
Figure 13:
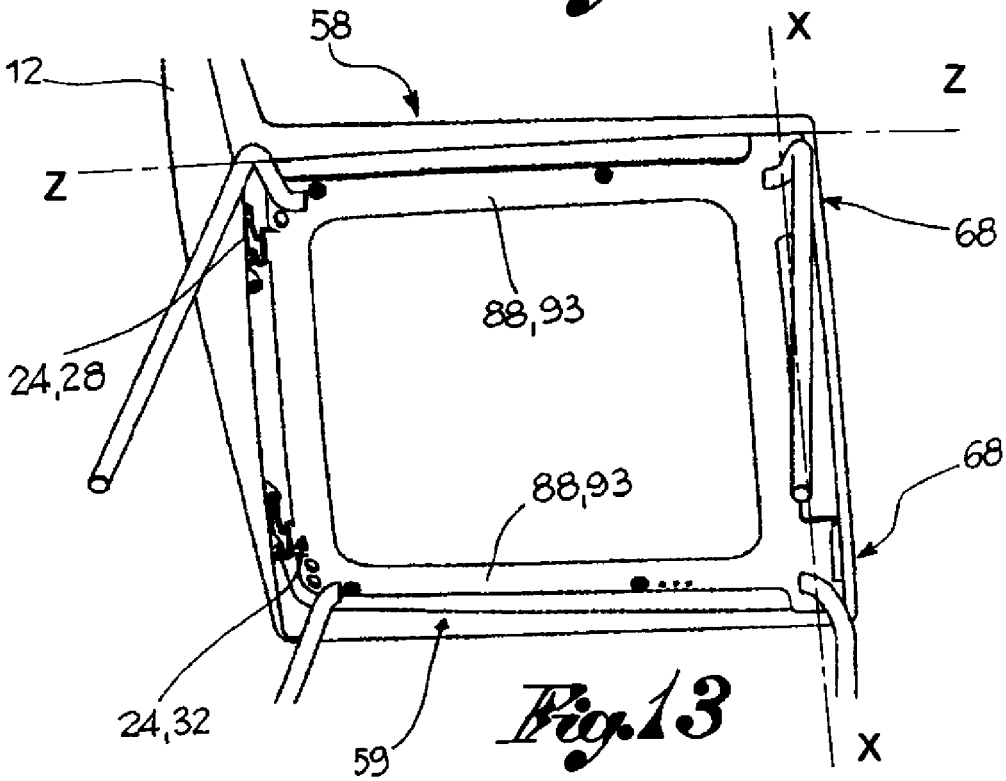

The elastic hook 28 is then brought into contact with the protuberance 32 (FIGS. 5, 10): the presence of the slot 52 facilitates the elastic snapping of the hook 28 which engages on the undercut 44 of the protuberance 32 (FIGS. 6, 11, 13).

Following assembly, a bilateral axial constraint is formed between the frame 8 and the seat 12 in a longitudinal direction Z-Z, in that any movements in the two directions along said longitudinal direction Z-Z are prevented on the front portion 57 by the presence of the bent portion 76 which is attached to the bracket 72, and on the rear portion 56 by the presence of the elastic hook 28 which with its coupling end 36 opposes the sliding of the protuberance 32 towards the backrest 20.

Lastly, to dismantle the seat element 4, it is sufficient to act elastically on the hooks 28, for example with the tip of a screwdriver, so as to disengage the protuberances 32, rotate the seat 12 upwards and lastly is disengage the bent portion 76 from the bracket 72.

As may be appreciated from the description, the seat element according to the present teaching makes it possible to overcome the drawbacks presented in the prior art.

In particular, the seat element proves particularly convenient and easy to assemble and dismantle.

The coupling and release element does not cause any abrasion of the seat or of the seat covering when present.

The coupling element is sturdy and does not break even if the assembly and dismantling steps are performed repeatedly.

The coupling element is small in size and is practically invisible in normal conditions of use of the seat element.

The cost of producing and assembling the coupling element is extremely limited and substantially does not influence the overall cost of the seat element.

Thanks to the present teaching it is possible to store and transport the seat elements in a practical and convenient manner.

Lastly, the number of machines and amount of labor used for the production of the seat elements is reduced.

A person skilled in the art may make numerous modifications and variations to the seat elements described above so as to satisfy contingent and specific requirements, all contained within the sphere of protection as defined by the appended claims.

The invention claimed is:

1. A seat element, comprising:

a frame able to sustain an associable seat and provided with at least one support, such as a leg or a foot; and a seat associable to said frame, the seat defining a seat plane; the frame and the seat being made separately from each other and being attachable and detachable from each other by the interposition of a first coupling and a second coupling separate from the first coupling, wherein:

said first coupling comprises at least one elastic hook and a protuberance, able to form an elastic snap coupling with each other, wherein the at least one elastic hook is attached to the seat and housed inside hollows made in the seat, the protuberance overhangs and extends above the top of the frame and having a seat supporting surface facing the seat and is counter-shaped to a corresponding lower portion of the seat, the elastic hook being configured to and positioned so as to intercept the protuberance in a vertical assembly direction, substantially perpendicular to the seat plane, the elastic hook having a coupling end and a v-shaped hook end flexible in relation to the coupling end, the elastic hook presents a slot directly facing the protuberance so as to facilitate an elastic snap hook onto an undercut of the protuberance in the vertical assembly direction, wherein a first side of the v-shaped hook end includes a contacting end that contacts with and secures the protuberance to the lower portion of the seat and wherein the coupling end opposes a sliding of the protuberance toward a backrest of the seat; and wherein:

the second coupling comprises:

a bracket joined to the frame and overhanging the frame to face the seat; and a bent portion formed in the seat and bent toward the frame to form a housing receiving and covering the bracket, the second coupling being a shaped coupling of a type rotating in relation to a transversal rotation axis, perpendicular to the vertical assembly direction, such that rotating of the seat and the frame relative to one another about the transverse rotation axis defined by the second coupling enables snap engagement of the first coupling.

2. The seat element according to claim 1, wherein the protuberance is fixed to the frame and the elastic hook is fixed to the seat on the lower portion of the seat directly facing the frame.

3. The seat element according to claim 2, wherein the protuberance is counter-shaped to the corresponding lower portion of the seat, on the side opposite the associable elastic hook, so as to form a support for the seat in an assembled configuration of the seat element.

4. The seat element according to claim 1, wherein said first coupling is aligned along a rear portion of the seat element, at an associable backrest of the seat element.

5. The seat element according to claim 1, wherein said first coupling is positioned along at least two separate portions of the seat element.

6. The seat element according to claim 1, wherein the elastic hook is attached to the seat and the protuberance is attached to the frame.

7. The seat element according to claim 1, wherein the elastic hook is housed inside the hollow made in the seat so as not to be visible on the outside, said hollow being open towards the associable frame.

8. The seat element according to claim 1, wherein said protuberance is joined to the frame and overhang the frame so as to be facing the associable seat.

9. The seat element according to claim 1, wherein the first and the second couplings are positioned on opposite portions or sides which, in an assembled configuration, form a bilateral axial constraint in a longitudinal direction, perpendicular to said portions and to the transversal rotation axis.

10. The seat element according to claim 1, wherein the first and the second couplings are positioned at a rear and front portion of the seat respectively, or vice versa.

11. The seat element according to claim 1, comprising blocking means for preventing translation between the seat and the frame in a direction parallel to the transversal rotation axis.

12. The seat element according to claim 11, wherein said blocking means comprise pegs which fit into corresponding holes so as to achieve the relative blocking of the seat to the frame in the direction of the transversal rotation axis.

13. The seat element according to claim 12, wherein the pegs are made in the seat, on the lower portion, and the holes are made on the frame, at corresponding support plates for the associable seat.

14. A seat element, comprising:

a frame able to sustain an associable seat and provided with at least one support, such as a leg or a foot; and a seat associable to the frame, the seat defining a seat plane;

the frame and the seat being made separately from each other and being attachable and detachable from each other by the interposition of a first coupling, wherein the first coupling comprises a plurality of elastic hooks and corresponding protuberances able to form corresponding snap couplings with each other, wherein each elastic hook is attached to the seat and housed inside hollows made in the seat;

each protuberance overhangs and extends above the top of the frame and having a seat supporting surface facing the seat and are counter-shaped to a corresponding lower portion of the seat;

each elastic hook being configured to and positioned so as to intercept a corresponding protuberance in a vertical assembly direction, substantially perpendicular to the seat plane, each elastic hook having a coupling end and a v-shaped hook end, flexible in relation to the coupling end, each elastic hook presents a slot directly facing the corresponding protuberance so as to facilitate an elastic snap hook onto an undercut of the protuberance in the vertical assembly direction, wherein a first side of each v-shaped hook end includes a contacting end that contacts with and secures the corresponding protuberance to the lower portion of the seat and wherein the each coupling end opposes a sliding of each corresponding protuberance toward a backrest of the seat; and a plurality of pegs made in the seat, on the lower portion, and a plurality of holes made on the frame at corresponding support plates for the seat, the pegs fitting into the holes and operable to prevent translation of the seat relative to the frame about a transverse rotation axis defined between the seat and the frame at a second rotary coupling opposite to the first coupling.

15. The seat element of claim 14, wherein a second coupling comprises:

a bracket joined to the frame and overhanging the frame to face the seat; and a bent portion formed in the seat and bent toward the frame to form a housing receiving and covering the bracket, such that rotating of the seat and the frame relative to one another about the transverse rotation axis defined by the second coupling enables snap engagement of the first coupling.

* * * * *